US007848686B2

(12) United States Patent
Inoue et al.

(10) Patent No.: US 7,848,686 B2
(45) Date of Patent: Dec. 7, 2010

(54) DEVELOPING DEVICE AND IMAGE FORMING APPARATUS

(75) Inventors: Toyotsune Inoue, Osaka (JP); Takahisa Nakaue, Osaka (JP); Akihiro Watanabe, Osaka (JP); Masashi Fujishima, Osaka (JP); Shoichi Sakata, Osaka (JP); Yukihiro Mori, Osaka (JP)

(73) Assignee: Kyocera Mita Corporation (JP)

( * ) Notice: Subject to any disclaimer, the term of this patent is extended or adjusted under 35 U.S.C. 154(b) by 408 days.

(21) Appl. No.: 12/127,151

(22) Filed: May 27, 2008

(65) Prior Publication Data

US 2008/0298847 A1 Dec. 4, 2008

(30) Foreign Application Priority Data

May 31, 2007 (JP) ..... 2007-144853
May 15, 2008 (JP) ..... 2008-127967

(51) Int. Cl.
*G03G 15/09* (2006.01)
*G03G 15/08* (2006.01)

(52) U.S. Cl. ..... 399/272; 399/276; 399/277; 399/267; 430/122.1; 430/122.2; 430/123.58

(58) Field of Classification Search ..... 399/267, 399/272, 276, 277; 430/122.1, 122.2, 123.58
See application file for complete search history.

(56) References Cited

U.S. PATENT DOCUMENTS 4,324,483 A * 4/1982 Tagawa et al. ..... 399/272
5,523,533 A * 6/1996 Itoh et al. ..... 399/272
5,768,666 A * 6/1998 Ito et al. ..... 399/273
6,389,253 B1 * 5/2002 Nonomura et al. ..... 399/149
6,901,233 B2 * 5/2005 Aoki et al. ..... 399/270
2007/0059047 A1 * 3/2007 Kamiya et al. ..... 399/276
2007/0231019 A1 * 10/2007 Nagai ..... 399/276
2008/0124137 A1 * 5/2008 Nakaue et al. ..... 399/277
2008/0205943 A1 * 8/2008 Aimoto ..... 399/284
2008/0232860 A1 * 9/2008 Sakata et al. ..... 399/270

FOREIGN PATENT DOCUMENTS

JP 09034266 A * 2/1997
JP 09211971 A * 8/1997
JP 11202600 A * 7/1999
JP 2005-274924 10/2005

* cited by examiner

*Primary Examiner*—David M Gray
*Assistant Examiner*—Francis Gray
(74) *Attorney, Agent, or Firm*—Gerald E. Hespos; Michael J. Porco

(57) ABSTRACT

A developing device uses a two-component developer including at least carriers and toners. The toners are supplied to an image bearing member bearing an electrostatic latent image so that a toner image is developed from the electrostatic latent image. The developing device has a developing roller arranged to oppose the image bearing member; and a magnetic roller arranged to oppose the developing roller. The magnetic roller retains the two-component developer to supply toners to the developing roller. The developing roller and the magnetic roller are rotationally driven in directions to be opposite from one another at an opposed position, and a magnetic pole of the magnetic roller and a magnetic pole of the developing roller have magnetic polarities different from one another at the opposed position. A surface roughness of the magnetic roller is greater than a surface roughness of the developing roller.

8 Claims, 4 Drawing Sheets

FIG. 4

| | SURFACE ROUGHNESS OF DEVELOPING ROLLER (Rz : μm) | SURFACE ROUGHNESS OF MAGNETIC ROLLER (Rz : μm) | LEAKAGE OF DEVELOPER CARRIER ADHERENCE |
|---|---|---|---|
| EXAMPLE 1 | 3 | 15 | ○ |
| EXAMPLE 2 | 3 | 10 | ○ |
| EXAMPLE 3 | 3 | 25 | ○ |
| EXAMPLE 4 | 10 | 12 | △ |
| COMPARATIVE EXAMPLE 1 | 10 | 3 | × × |
| COMPARATIVE EXAMPLE 2 | 10 | 10 | × |
| COMPARATIVE EXAMPLE 3 | 3 | 26 | △ |

○・・・NO ACCUMULATION OF DEVELOPER IN MS

△・・・SMALL ACCUMULATION OF DEVELOPER IN MS

×・・・CARRIER ADHERENCE ON SURFACE

× ×・・・LEAKAGE OF DEVELOPER ONTO DOCTOR BLADE (LEAKAGE OF DEVELOPER AND CARRIER ADHERENCE ARE DETERMINED VISUALLY)

DEVELOPING DEVICE AND IMAGE FORMING APPARATUS

BACKGROUND OF THE INVENTION

1. Field of the Invention

The present invention relates to a developing device provided in image forming apparatuses such as a facsimile machine, a copying machine, and a printer, and an image forming apparatus provided with the developing device.

2. Description of the Related Art

As an example of the developing device described above, there has been a known developing device in which a magnetic roller is further arranged to oppose a developing roller which is arranged to oppose an image bearing member (for example, a photoconductive drum), and magnetic poles having magnetic polarities different from one another are provided in the developing roller and the magnetic roller so as to improve a binding force of a magnetic brush formed between the developing roller and the magnetic roller (for example, refer to Japanese Patent Unexamined Publication No. 2005-274924).

However, while the image forming apparatus provided with the developing device can improve an ability of collecting toners on the developing roller, the binding force of the magnetic brush causes a developer to accumulate in a periphery between the developing roller and the magnetic roller. Such accumulation disadvantageously causes the developer to blow out of the developing device to contaminate inside of the image forming apparatus or causes so-called carrier adherence such as adherence of the developer to a surface of the image bearing member.

SUMMARY OF THE INVENTION

The present invention was made to solve such problems of the conventional technology, and its object is to prevent accumulation of the developer in a periphery between the developing roller and the magnetic roller in the developing device.

In summary, the present invention includes a developing device in which a two-component developer including at least carriers and toners is used and the toners are supplied to an image bearing member bearing an electrostatic latent image so that a toner image is developed from the electrostatic latent image, and the developing device includes: a developing roller so arranged as to oppose the image bearing member; and a magnetic roller so arranged as to oppose the developing roller, the magnetic roller retaining the two-component developer to supply toners to the developing roller. The developing roller and the magnetic roller are rotationally driven in such directions as to be opposite from one another at an opposed position, and a magnetic pole of the magnetic roller and a magnetic pole of the developing roller have magnetic polarities different from one another at the opposed position, and a surface roughness of the magnetic roller is greater than a surface roughness of the developing roller.

These and other objects, features and advantages of the present invention will become more apparent upon reading of the following detailed description along with the accompanied drawings.

BRIEF DESCRIPTION OF THE DRAWINGS

FIG. 4 is a table showing results of visual observation concerning presence or absence of accumulation of developer and carrier adherence on an image formed on a photoconductive drum in relation to modifications of a surface roughness of a developing roller and a surface roughness of a magnetic member.

DETAILED DESCRIPTION OF THE PREFERRED EMBODIMENTS

Figure 1:
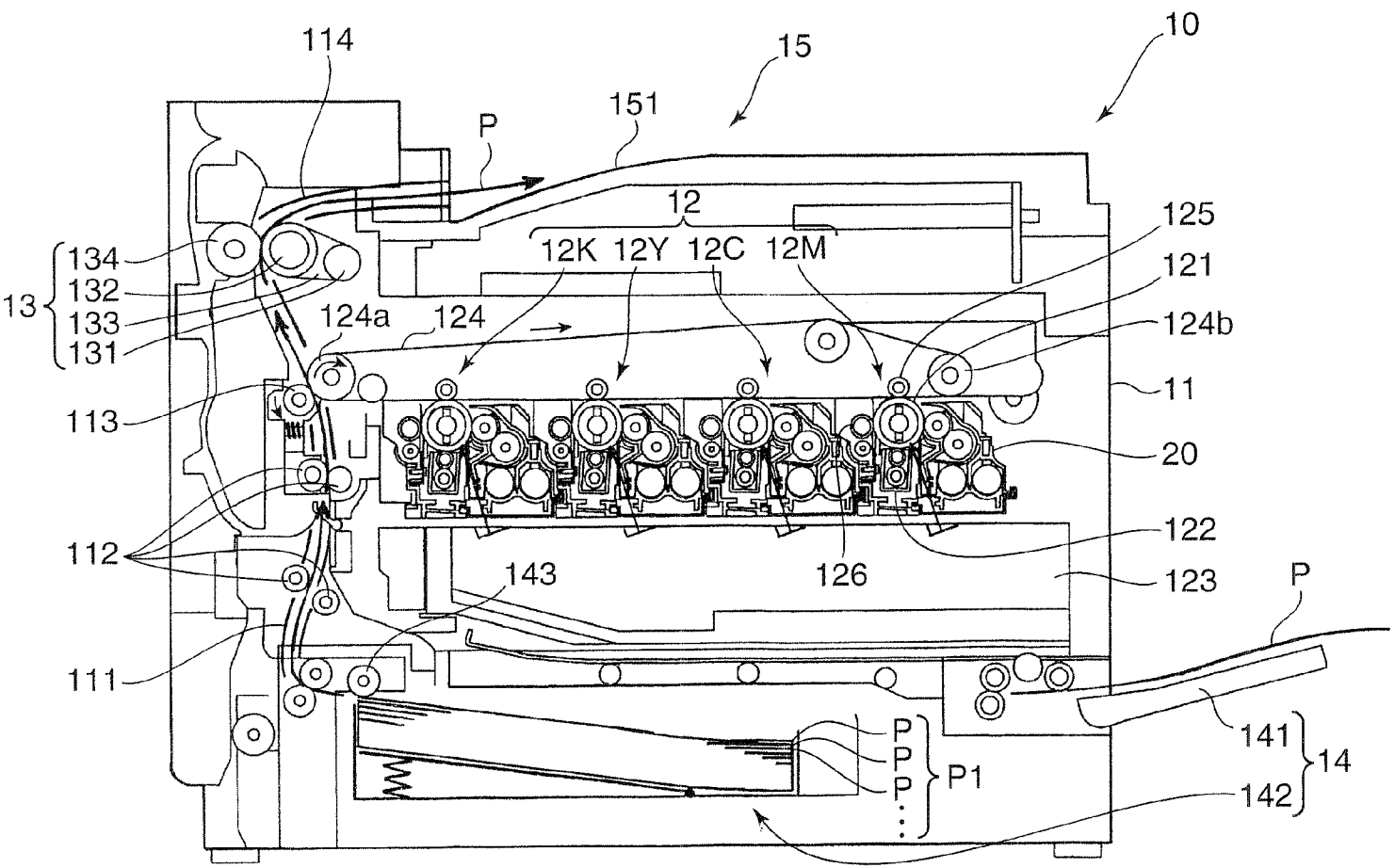
FIG. 1 is a front sectional view showing an embodiment of an internal structure of a printer.

Firstly, an outline of an internal structure of a printer provided with a developing device in accordance with an embodiment of the present invention will be described with reference to FIG. 1. FIG. 1 is a front sectional view showing an internal structure of the printer in accordance with the embodiment of the present invention. A printer (image forming apparatus) 10 in accordance with the present embodiment is covered with an apparatus main body 11 having a box shape. The printer 10 has a basic configuration including an image forming section 12 for forming an image based on image information transmitted from an external equipment such as a computer, a fixing section 13 for performing a fixing processing to the image transferred from the image forming section 12 onto a sheet P, a sheet storage section 14 for storing the sheet P onto which the image is transferred, and a sheet discharging section 15 provided on top of the apparatus main body 11 for discharging the sheet P after the fixing processing is performed.

The image forming section 12 is adapted to form a toner image onto the sheet P fed from the sheet storage section 14 and has a transfer belt 124 extending between a driving roller 124*a* and a driven roller 124*b*. The transfer belt 124 is rotated in a clockwise direction, and four units 12M, 12C, 12Y, and 12K are sequentially provided from an upstream side (right side) toward a downstream side in the rotational direction. The units 12M, 12C, 12Y, and 12K use toners (developer) of magenta, cyan, yellow, and black, respectively.

Each of the units 12M, 12C, 12Y, and 12K includes a photoconductive drum (image bearing member) 121 and a developing device 20. The photoconductive drum 121 is adapted to bear on its peripheral surface an electrostatic latent image and a toner image (visible image) based on the electrostatic latent image. Further, an extremely smooth amorphous silicon layer being tough and having an excellent abrasion resistance is formed on the peripheral surface. This makes the photoconductive drum 121 be suitable to bear the images. Each photoconductive drum 121 receives supply of toners from a corresponding developing device 20 while rotating in a counter-clockwise direction in FIG. 1. Each developing device 20 receives supply of toners from an unillustrated toner cartridge which is provided on a front surface side (front side of the sheet of FIG. 1) of the apparatus main body 11.

In the present embodiment, so-called two-component developer including toners and carriers is adopted. The toners are fine powders each having a particle diameter of 5-12 μm and made by dispersing additive agents such as a coloring agent, a charge control agent, and a wax in a binder resin. On the other hand, carriers are magnetic particles such as magnetite ($Fe_3O_4$) each having a particle diameter of 25-100 μm. The carriers are used for electrically charging the toners. The toners are consumable supplies which are supplied appropriately from an unillustrated toner cartridge to the developing device 20. On the other hand, a predetermined amount of carriers are provided in the developing device 20, and the carriers are generally circulated without being consumed. A weight percentage (T/C) of toners (T) and carriers (C) is set to be about 8 wt %.

At a position directly under each photoconductive drum 121, a charging device 122 is provided respectively. At a position under each charging device 122, an exposure device 123 is provided. A peripheral surface of each photoconductive drum 121 is uniformly charged by a respective charging device 122, and a laser light corresponding to a respective color based on image data inputted from a computer or the like is irradiated from the exposure device 123 to the charged peripheral surface of the photoconductive drum 121. Accordingly, an electrostatic latent image is formed on a respective peripheral surface of each photoconductive drum 121. Toners are supplied from the developing device 20 to the electrostatic latent image, so that a toner image is formed on a peripheral surface of the photoconductive drum 121.

The transfer belt 124 is rotated in synchronization with the photoconductive drums 121 while being pressed onto the peripheral surfaces of the photoconductive drums 121 by transferring rollers 125 provided correspondingly to the photoconductive drums 121. Thus, a magenta toner image is transferred from the photoconductive drum 121 of the magenta unit 12M to the surface of the transfer belt 124. After that, a cyan toner image is transferred from the photoconductive drum 121 of the cyan unit 12C to the same position of the transfer belt 124 in superimposition. After that, a yellow toner image is transferred from the photoconductive drum 121 of the yellow unit 12Y to the same position of the transfer belt 124 in superimposition. Finally, a black toner image is transferred from the photoconductive drum 121 of the black unit 12K in superimposition. Accordingly, a color toner image is formed on the surface of the transfer belt 124. Then, the color toner image formed on the surface of the transfer belt 124 is transferred onto the sheet P conveyed from the sheet storage section 14.

On a left side position of each photoconductive drum 121 in FIG. 1, a cleaning device 126 is provided, so that the cleaning device 126 removes toners remaining on the peripheral surface of the photoconductive drum 121 for cleaning. The peripheral surface of the photoconductive drum 121 cleaned in such manner moves to the charging device 122 for newly performed charge processing. Further, waste toners removed by the cleaning device 126 from the peripheral surface of the photoconductive drum 121 pass through a predetermined passage and are collected by an unillustrated toner-collecting bottle and stored therein.

On a left side position of the image forming section 12 in FIG. 1, a sheet conveying passage 111 extending in a vertical direction is formed. The sheet conveying passage 111 is provided with a pair of conveying rollers 112 at appropriate portions, and the sheet from the sheet storage section 14 is conveyed by driving of the pair of conveying rollers 112 toward the transfer belt 124 wound around the driving roller 124*a*. The sheet conveying passage 111 is provided with a second transferring roller 113 which is in contact with the surface of the transfer belt 124 at a position opposing the driving roller 124*a*. The sheet P conveyed through the sheet conveying passage 111 is supplied to a nip portion formed between the transfer belt 124 and the second transferring roller 113, and the toner image formed on the transferring belt 124 is pressed and nipped at the nip portion so as to be transferred to the sheet P.

The fixing section 13 is adapted to apply the fixing processing to the toner image which is transferred to the sheet in the image forming section 12. The fixing section 13 includes a heating roller 131 having an electric heating member as a heat source, a fixing roller 132 arranged on a left side in FIG. 1 so as to oppose the heating roller 131, a fixing belt 133 extending between the fixing roller 132 and the heating roller 131, and a pressing roller 134 so arranged as to oppose the fixing roller 40 through the fixing belt 133.

The sheet P onto which the toner image is transferred obtains a heat from the fixing belt 133 while passing through the pressing roller 134 and the high-temperature fixing belt 133, so that the fixing processing is applied.

After the fixing processing is completed, the sheet P bearing the color image passes through a sheet-discharging conveying passage 114 extending from a top of the fixing section 13 and is discharged to the sheet-discharging tray 151 of the sheet discharging section 15 provided on top of the apparatus main body 11.

The sheet storage section 14 includes a manual feeding tray 141 provided on a right side wall of the apparatus main body 11 in FIG. 1 openably and closably and a sheet tray 142 dismountably mounted at a position under the exposure device 123 in the apparatus main body 11. A stack of sheets is stored in the sheet tray 142.

The manual feeding tray 141 is adapted to feed the sheets P one after another to the image forming section 12 by a manual operation. The manual feeding tray 141 is normally accommodated in the right wall surface of the apparatus main body 11. Only when the sheets P are manually fed, the manual feeding tray 141 is pulled out of the wall surface as shown in FIG. 1 and used for the manual feeding.

The sheet tray 142 has a box shape having an open upper surface, and it can store a sheet stack P1 including a plurality of stacked sheets P. An upper surface on a downstream end (left end in FIG. 1) of an upper most sheet P of the sheet stack P1 stored in the sheet tray 142 is sent out from the sheet stack P1 toward the sheet conveying passage 111 by driving of the pickup roller 143, and the sheets P are sent out one after another by driving of the pair of conveying rollers 112, pass through the sheet conveying passage 111, and are sent to a nip portion between the second transferring roller 113 and the transfer belt 124 in the image forming section 12.

Figure 2:
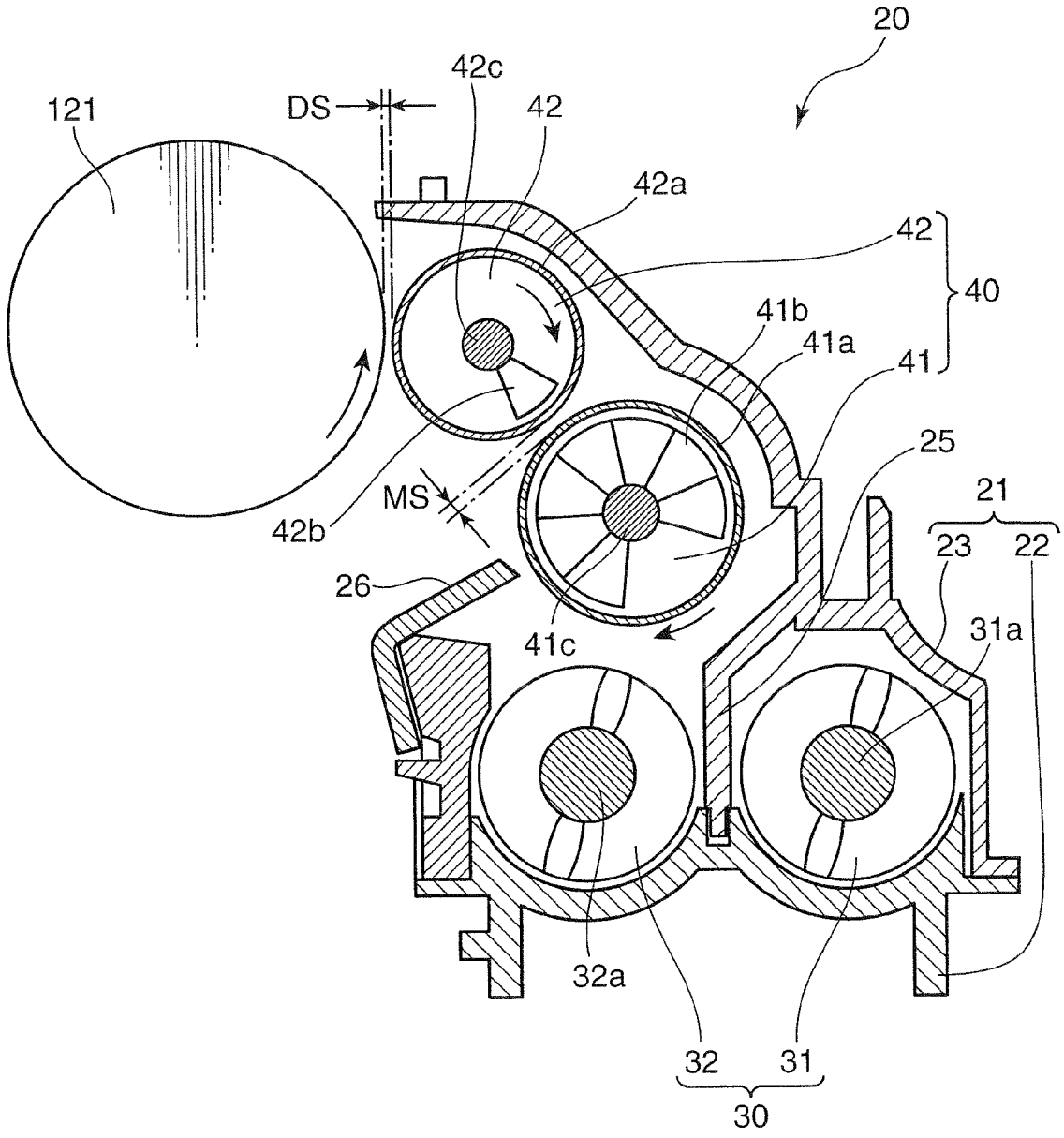
FIG. 2 is a front sectional view showing a developing device in accordance with an embodiment of the present invention.
Figure 3:
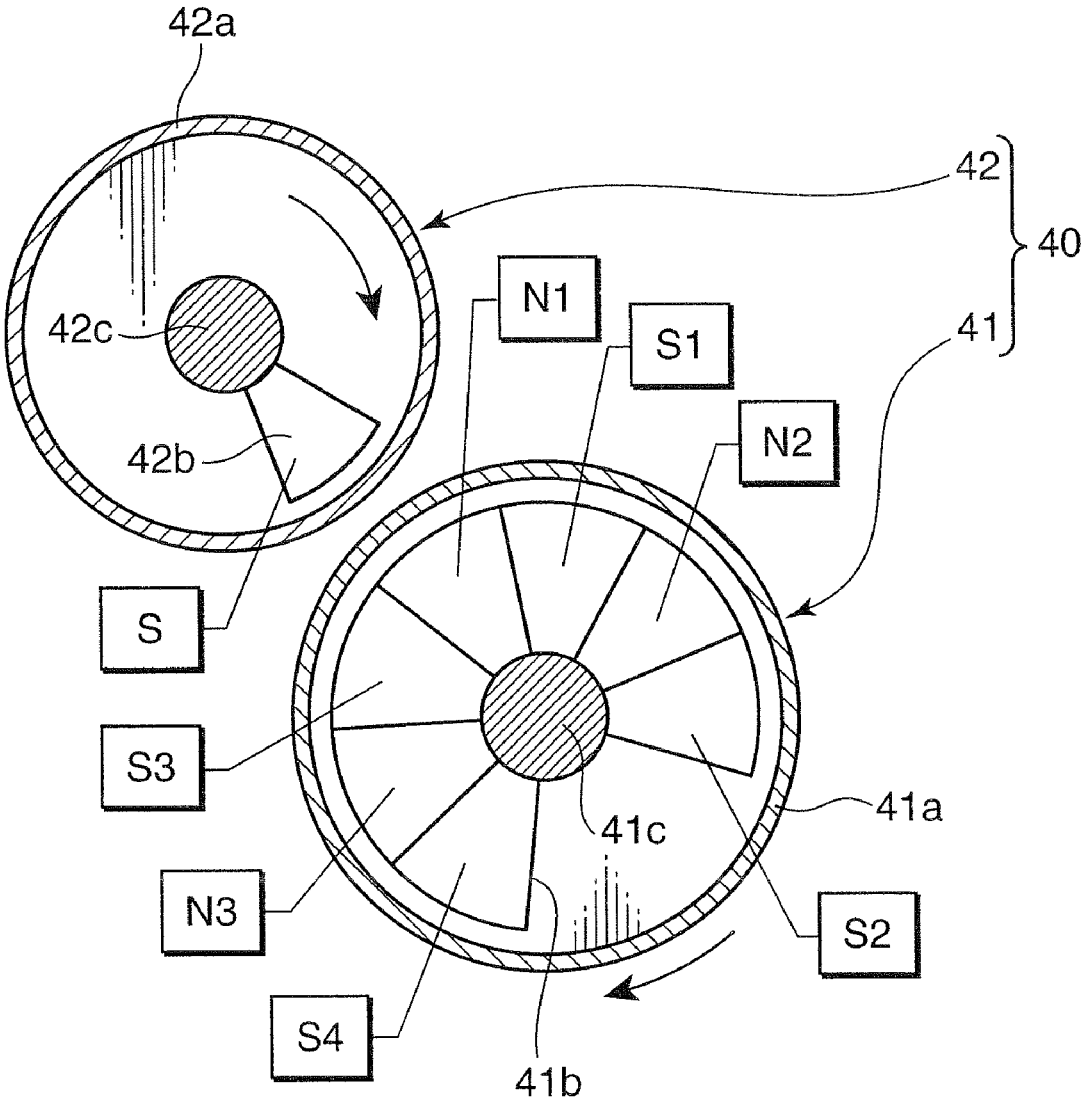
FIG. 3 is a front sectional view showing relevant parts of the developing device shown in FIG. 2 in an enlarged manner.

FIG. 2 is a front sectional view showing a developing device in accordance with the first embodiment of the present invention. FIG. 3 is a front sectional view showing relevant parts of the developing device in an enlarged manner.

The developing device 20 includes a toner stirring mechanism 30 provided in a housing (casing) 21 which is long in a forward and backward direction for stirring the toners, and a toner supplying mechanism 40 for supplying the toners stirred by the toner stirring mechanism 30 to the peripheral surface of the photoconductive drum 121.

The housing 21 has a two-part structure including a lower housing 22 and an upper housing 23. A toner stirring mechanism 30 is mounted between the lower housing 22 and the upper housing 23, and the toner supplying mechanism 40 is mounted in the upper housing 23.

The toner stirring mechanism 30 includes a first spiral feeder 31 and a second spiral feeder 32. The first spiral feeder 31 is provided on a right side of a separating wall 25, and the second spiral feeder 32 is provided on a left side of the separating wall 25. Communication openings (not illustrated) are formed in a rear end and a front end of the separating wall 25, respectively. The feeders 31 and 32 rotate respectively about axes 31*a* and 32*a* which are long in a forward and backward direction perpendicular to the sheet of FIG. 2.

Therefore, the toners conveyed by rotation of the first spiral feeder 31 rearward through, for example, a space on the right side of the separating wall 25 in the lower housing 22 are conveyed to a space on the left side of the separating wall 25 through the rear communication opening (not illustrated). Then, the toners are conveyed forward by rotation of the second spiral feeder 32. A part of the toners conveyed by the second spiral feeder 32 is lifted up by the toner supplying mechanism 40 above, and remainder of the toners are put back to the space on the right side of the separating wall 25 through the front communication opening (not illustrated) and circulated.

The toner supplying mechanism 40 is adapted to supply the toners lifted up by the toner stirring mechanism 30 to the photoconductive drum 121. The toner supplying mechanism 40 includes a magnetic roller 41 provided on an upper side of the second spiral feeder 32 and a developing roller 42 provided on an upper oblique left side of the magnetic roller 41. The rollers 41 and 42 are long in a forward and backward direction and so provided as to be parallel with each other, and the peripheral surfaces of those are opposing each other and spaced apart by a small clearance MS therebetween. The rollers 41 and 42 are rotationally driven in directions opposite from one another at their opposed position. In the example shown in FIG. 2, both the rollers 41 and 42 are rotated in a clockwise direction.

The magnetic roller 41 includes a cylindrical sleeve 41*a* having a thin-layered and non-magnetic member such as aluminum formed on its peripheral surface, a magnetic member 41*b* provided inside the sleeve 41*a*, a shaft 41*c* provided coaxially with the sleeve 41*a* and formed integrally with the magnetic member 41*b*, and an unillustrated magnetic roller rotating shaft provided integrally with the sleeve 41*a*. The magnetic member 41*b* includes a plurality of N-poles and a plurality of S-pole magnets provided alternately. For example, in the present embodiment, at the magnetic member 41*b*, an N-pole (N1) is provided at a part opposing the developing roller 42 through the clearance MS. On a right side of the N-pole (N1), there are provided an S-pole (S1), an N-pole (N2), and an S-pole (S2). On a left side of the N-pole (N1), there are provided an S-pole (S3), an N-pole (N3), and an S-pole (S4).

One end of the magnetic member 41*b* of the magnetic roller 41 is fixed to the shaft 41*c*. The shaft 41*c* is fixed to the housing 21 of the developing device 20. The magnetic roller rotating shaft is rotated by a rotational drive force applied by a drive power source such as an unillustrated motor, but the shaft 41*c* is fixed to the housing 21 so as not to be rotated.

The developing roller 42 includes a cylindrical sleeve 42*a* having a thin-layered and non-magnetic member such as aluminum formed on its peripheral surface, a magnetic member 42*b* provided inside the sleeve 42*a*, a shaft 42*c* provided coaxially with the sleeve 42*a* and formed integrally with the magnetic member 42*b*, and an unillustrated developing roller rotating shaft provided integrally with the sleeve 42*a*. The magnetic member 42*b* is provided at a part opposing the developing roller 42 through the clearance MS and has an S-pole.

One end of the magnetic member 42*b* of the developing roller 42 is fixed to the shaft 42*c*. The shaft 42*c* is fixed to the housing 21 of the developing device 20. The developing roller rotating shaft is rotated by a rotational drive force applied by the drive power force such as an unillustrated motor, but the shaft 42*c* is fixed to the housing 21 so as not to be rotated.

Further, the N-pole (N1) in the magnetic member 41*b* of the magnetic roller 41 is arranged at a position shifted to a downstream side in the rotational direction of the magnetic roller 41 by 5° (preferably, 0-8°) with respect to a line segment connecting an axis of the developing roller 42 and an axis of the magnetic roller 41. On the other hand, the S-pole in the magnetic member 42*b* of the developing roller 42 is arranged at a position shifted to an upstream side of the rotational direction of the developing roller 42 by 5° (preferably, 0-8°) with respect to the line segment.

An operation of the developing device 20 at the time of performing the developing operation will be described. As described above, the developer is stirred by the feeders 31 and 32 of the toner stirring mechanism 30 in the developing device 20 so that the toners are electrically charged. A rotational drive force from the drive power source is transmitted to the magnetic roller rotating shaft for rotation of the magnetic roller 41, and the sleeve 41*a* is rotated concurrently. On the other hand, the magnetic member 41*b* is not rotated. For example, the sleeve 41*a* is rotationally driven in a direction indicated by the solid line arrow in FIG. 2. The developer on the feeder 32 is attracted by the magnetic roller 41, so that a magnetic brush is formed on the surface of the magnetic roller 41. A layer of the magnetic brush formed on the magnetic roller 41 is restricted by a doctor blade 26, so that a toner layer is formed on the developing roller 42 by the difference in electric potential between the magnetic roller 41 and the developing roller 42. The electrostatic latent image formed on the photoconductive drum 121 is developed by the toner layer formed on the developing roller 42.

After the developing processing is performed in such a manner as described above, the developing roller 42 having a layer of remaining toners comes closest to the magnetic roller 41 having a developer layer at the opposed position described above. At this opposed position, a mechanical force applied by the magnetic brush and the difference in electric potential scrape off the toner layer from the developing roller 42, and toners are supplied from the developer layer on the magnetic roller 41 to the developing roller 42 in accordance with the difference in electric potential (in other words, electric field) formed between the magnetic roller 41 and the developing roller 42.

The developing roller 42 and the magnetic roller 41 are rotationally driven so as to rotate in opposite directions at the opposed position, and the magnetic pole of the magnetic roller 41 and the magnetic pole of the developing roller 42, having magnetic polarities different from one another, are arranged at the opposed position. Accordingly, a magnetic field is formed between the magnetic pole of the magnetic roller 41 and the magnetic pole of the developing roller 42.

The magnetic field formed between the magnetic poles strengthens a binding force of the magnetic brush, in other words, forms a favorable magnetic brush. Accordingly, the toners on the developing roller 42 are mechanically scraped off by magnetic brush formed by the carriers. Then, the toners are forced back to the magnetic roller 41.

Since the force for scraping off the toners by the magnetic brush is strengthened in such a manner as described above, the toners remaining on the developing roller 42 can be collected to the magnetic roller 41 securely, so that a history of the previous developing process does not remain on the developing roller 42. Further, as shown in FIG. 2, arranging the magnetic roller 41 on a lower side of the developing roller 42 causes a gravity to be applied to the toners at the time when the toners on the developing roller 42 are collected. As a result, the toners are collected efficiently.

Next, a relationship between a surface roughness of the developing roller and a surface roughness of the magnetic roller will be described with reference to FIG. 4.

FIG. 4 is a table showing results of visual observation concerning presence or absence of accumulation of developer and carrier adherence on an image formed on a photoconductive drum in relation to modifications of a surface roughness of a developing roller and a surface roughness of a magnetic member. In the example 1, a ten-point average surface roughness Rz(slv) of the developing roller is 3 μm, and a ten-point average surface roughness Rz(mag) of the magnetic roller is 15 μm. In the example 2, the Rz(slv) is 3 μm, and the Rz(mag) is 10 μm. In the example 3, the Rz(slv) is 3 μm, and the Rz(mag) is 25 μm. In the example 4, the Rz(slv) is 10 μm, and the Rz(mag) is 12 μm. In the comparative example 1, the Rz(slv) is 10 μm, and the Rz(mag) is 3 μm. In the comparative example 2, the Rz(slv) is 10 μm, and the Rz(mag) is 10 μm. In the comparative example 3, the Rz(slv) is 3 μm, and the Rz(mag) is 26 μm. The marking "○" in the table 1 indicates that there is no accumulation of the developer in the clearance MS. The marking "Δ" indicates that a small amount of accumulation occurred in the clearance MS. The marking "x" indicates that the carriers adhered to the image on the photoconductive drum. The marking "xx" indicates that the developer leaked onto the doctor blade 26 (refer to FIG. 2).

The conditions are as follows. Regarding the developing roller 42, a surface roughness of an aluminum tube having a diameter of 16 mm is adjusted by outline processing and center-less grinding. Further, an AC voltage of 1.6 kV having a frequency of 4 kHz and a duty ratio of 30% and a DC voltage of 30V are applied, and a magnetic force of the S-pole is set to be 45 mT. Regarding the magnetic roller 41, a surface roughness is adjusted by performing the outline processing to an aluminum tube having a diameter of 20 mm and thereafter applying at least one of a sand blast processing, a bead blast processing, an almite processing, and a buffing. Further, an AC voltage of 0.4 kV having a frequency of 4 kHz and a duty ratio of 70% and a DV voltage of 300V are applied, and a magnetic force of the N-pole (N1) is set to be 85 mT. A clearance MS between the magnetic roller 41 and the developing roller 42 is set to be 0.300 mm. A ratio of a peripheral speed of the magnetic roller with respect to a peripheral speed of the developing roller is set to be 1.5. A ratio of a peripheral speed of the developing roller with respect to a peripheral speed of the photoconductive drum is set to be 1.5. A clearance DS between the photoconductive drum and the developing roller is set to be 0.200 mm. A diameter of the photoconductive drum is set to be 30 mm. A peripheral speed of the photoconductive drum is set to be 150 mm/sec. A surface electrical potential (Vo) of the photoconductive drum is set to be 350V Carriers each having a weight average particle diameter of 45 μm and a saturation magnetization of 60 emu/g and having a Mn—Mg based core coated with a resin is used, and a ratio of T (toners) with respect to C (carriers) was 8 wt %. Further, the ten-point average surface roughness Rz(slv) of the developing roller and the ten-point average surface roughness Rz(mag) of the magnetic roller are measured by using SURFCOM1500DX (JISB0601-1994) manufactured by Tokyo Seimitsu Co., Ltd. The measurement was performed under measurement conditions including a calculation standard of JIS-'94, a measurement method of a surface measurement, a measurement length of 4.0 mm, a cut-off wavelength of 0.8 mm, and a measurement speed of 0.3 mm/s.

As can be understood from FIG. 4, if the Rz(mag) is 26 μm and over 25 μm, accumulation of the developer occurs so that a leakage is likely to occur between the developing roller and the magnetic roller (refer to the comparative example 3). Further, if Rz(mag)/Rz(slv) becomes smaller than 1.3, disadvantages such carrier adherence on the photoconductive drum 121 or a leakage of the developer onto the doctor blade 26 may occur (refer to the comparative examples 1 and 2). On the other hand, when the Rz(mag) is greater than the Rz(slv) like the examples 1-4, accumulation of the developer is suppressed, and adherence of carriers onto the image on the photoconductive drum can be suppressed. Especially, when Rz(mag)/Rz(slv) is equal to or greater than 1.3 and the Rz(mag) is equal to or less than 25 μm like the examples 1-3, there was no accumulation of the developer and adherence of the carriers onto the image on the photoconductive drum, so that a favorable effect could be achieved.

Thus, according to the present invention, if the relationship between a surface roughness of the magnetic member and a surface roughness of the developing roller satisfies Rz(mag)/Rz(slv)≧1.3 and Rz(mag)≦25 μm, accumulation of the developer can be prevented, and adherence of carriers can be suppressed.

An ability of conveying the developers is lowered if the Rz(mag) becomes smaller than 10 μm. Accordingly, it is preferable that the Rz(mag) is 10-25 μm. It is more preferable that the Rz(mag) is 12-20 μm. Further, it is preferable that the Rz(slv) is 1-10 μm. It is more preferable that the Rz(slv) is 1-5 μm. If the Rz(slv) is smaller than 1 μm, the cost for improving the accuracy rises too much. On the other hand, if the Rz(slv) becomes greater than 10 μm, a leakage between the photoconductive drum and the developing roller is likely to occur. Further, adherence between the surface of the developing roller and the toners becomes high, so that collection of non-developed toners to the magnetic roller becomes difficult.

Further, according to the present invention, satisfying Rz(mag)/Rz(slv)≧1.3 and Rz(mag)≦25 μm makes it possible to secure prevention of accumulation of the developer and suppression of the carrier adherence, which are the effect of the present invention, in the case where resin carriers (including the carriers described above, and it is similarly applied hereinafter) are used as the carriers or a shape of each carrier is close to spherical. It will be described in detail herebelow.

Specifically, according to the present invention, accumulation of the developer and carrier transfer can be suppressed even if resin carriers having a density smaller than ferrite carriers, a small magnetic binding force, and a small flowability and being likely to cause the accumulation of the developers and the carrier transfer. Further, if the shape of each carrier becomes close to spherical, the contact points between the carriers become small, so that a binding force becomes small. However, if carriers each having a shape coefficient SF-1 of equal to or smaller than 135 to have a shape close to spherical are used, the present invention can suppress occurrence of the carrier transfer.

The shape coefficient SF-1 is represented by the formula of [(absolute maximum length of carriers)$^2$/(projected area of carriers)]*(χ/4)*100, and the absolute maximum length of carriers and the projected area of carriers adopts an average value of 100 carriers. For obtaining the value of SF-1, for example, FE-SEM(S-800) manufactured by Hitachi, Ltd. is used to randomly sampling hundred particles of the carriers enlarged by 100-300 times, and then an image analyzing device (Luzex III) manufactured by Nicore Corporation is used for analyzing the image information.

Further, in the present invention, the weight average particle diameter of the carriers is set to be equal to or smaller than 50 μm, and the saturation magnetization per 1 kiloersted is set to be 25-65 emu/g. This is because of the following reasons. Specifically, if the weight average particle diameter of the carriers is greater than 50 μm, the magnetic brush on the magnetic roller is not formed densely, so that the toner thin layer on the developing roller becomes unlikely to be formed evenly. Further, since the magnetic brush becomes nondense, collection of the toners on the developing roller becomes uneven, so that the ghost phenomenon is likely to occur. Therefore, by setting the weight average particle diameter to be equal to or smaller than 50 μm, the magnetic brush on the developing roller can be formed densely. If the magnetic brush on the developing roller becomes dense, movement of the developer between the developing roller and the magnetic roller will be restricted. Accordingly, accumulation of developer becomes likely to occur. However, setting the saturation magnetization per kilo-oersted to be within the range of 25-65 emu/g eliminates the accumulation of the developer. Further, if the saturation magnetization is smaller than 25 emu/g, a retaining force by a magnetic force becomes too weak. Accordingly, the carrier transfer and falling of the developer occur. On the other hand, if the saturation magnetization becomes greater than 65 emu/g, a binding force of the magnetic brush becomes too strong, so that the magnetic brush becomes too strong and causes unevenness in cleaning by the magnetic brush on the toner thin layer on the developing roller, which is not preferable.

The measurement value of the saturation magnetization can be obtained by measurement with use of, for example, "VSM-P7" manufactured by Toei Industry, Co., Ltd. at a magnetic field of 79.6 kA/m (1 kOe).

The present invention is not limited to the embodiment described above, and it includes the following.

(1) In the embodiment described above, the present invention is applied to the carriers each having a Mn—Mg based core coated with a resin. However, the present invention is not limited to this. For example, the present invention may be applied generally to resin carriers formed by dispersing the magnetic member in the bonded resin, so that the similar effect can be achieved.

(2) In the embodiment described above, the printer 10 is described as an image forming apparatus to which the developing device 20 is applied. However, the present invention is not limited to that the image forming apparatus is the printer 10. The image forming apparatus may be a copying machine or a facsimile machine.

In summary, the present invention includes a developing device in which a two-component developer including at least carriers and toners is used and the toners are supplied to an image bearing member bearing an electrostatic latent image so that a toner image is developed from the electrostatic latent image, and the developing device includes: a developing roller so arranged as to oppose the image bearing member; and a magnetic roller so arranged as to oppose the developing roller, the magnetic roller retaining the two-component developer to supply toners to the developing roller. The developing roller and the magnetic roller are rotationally driven in such directions as to be opposite from one another at an opposed position, and a magnetic pole of the magnetic roller and a magnetic pole of the developing roller have magnetic polarities different from one another at the opposed position, and a surface roughness of the magnetic roller is greater than a surface roughness of the developing roller.

Further, the present invention includes an image forming apparatus provided with a developing device in which a two-component developer including at least carriers and toners is used and to the toners are supplied to an image bearing member bearing an electrostatic latent image so that a toner image is developed from the electrostatic latent image, and the developing device includes: a developing roller so arranged as to oppose the image bearing member; and a magnetic roller so arranged as to oppose the developing roller, the magnetic roller retaining the two-component developer to supply toners to the developing roller. The developing roller and the magnetic roller are rotationally driven in such directions as to be opposite from one another at an opposed position of opposing each other, and a magnetic pole of the magnetic roller and a magnetic pole of the developing roller have magnetic polarities different from one another at the opposed position, and a surface roughness of the magnetic roller is greater than a surface roughness of the developing roller.

According to this invention, in the case of the developing device in accordance with the present invention, the developing roller and the magnetic roller are rotationally driven in such directions as to be opposite to one another at the opposed position, and a magnetic pole of the magnetic roller and a magnetic pole of the developing roller have magnetic polarities different from one another at the opposed position. Accordingly, a magnetic field is formed between the magnetic pole of the magnetic roller and the magnetic pole of the developing roller, so that a binding force of the magnetic brush is strengthened, in other words, a favorable magnetic brush is formed. Therefore, the toners on the developing roller are scraped off mechanically by the magnetic brush formed by the carriers and then pulled back to the side of the magnetic roller. Additionally, since a surface roughness of the magnetic roller is greater than a surface roughness of the developing roller, conveyance of the developer around the magnetic roller can be improved, so that accumulation of the developer in a periphery between the developing roller and the magnetic roller can be suppressed.

Further, according to the present invention, it is preferable that a ten-point average surface roughness Rz (mag) is used as the surface roughness of the magnetic roller, and a ten-point average surface roughness Rz (slv) is used as the surface roughness of the developing roller.

According to this invention, the degree of the surface roughness can be presented as a value, so that comparison of the surface roughness becomes easy.

Further, according to the present invention, it is preferable that a relationship between the Rz (mag) and the Rz (slv) is represented by Rz (mag)/Rz (slv)≧1.3, and the Rz (mag) is represented by Rz (mag)≦25 μm.

According to this invention, the following effect can be achieved. Specifically, if the surface roughness of the magnetic roller is made too great, conveyance of the magnetic roller becomes abnormally high to thereby cause leakage of toners between the magnetic roller and the developing roller to occur easily. In the case of this invention, since the surface roughness of the magnetic roller is set to be Rz(mag)≦25 μm, occurrence of the leakage can be suppressed. Further, since the relationship between the surface roughness of the magnetic roller and the developing roller is set to be Rz(mag)/Rz (slv)≧1.3, accumulation of the developer between the developing roller and the magnetic roller can be suppressed. Accordingly, the phenomenon in which the carriers move to the side of the developing roller, so called a carrier transfer, can be suppressed.

Further, according to the present invention, it is preferable that the magnetic roller retains the two-component developer including the carriers having a weight average particle diameter equal to or smaller than 50 μm and a saturation magnetization per 1 kilo-oersted of 25-65 emu/g, and supplies the toners to the developing roller.

According to this invention, the following effect can be achieved. Specifically, since the magnetic brush on the magnetic roller becomes difficult to be formed densely if the weight average particle diameter of the carriers becomes greater than 50 μm, the toner thin layer on the developing roller becomes difficult to be formed evenly, and collection of toners on the developing roller becomes uneven since the magnetic brush is not dense. Accordingly, a developing ghost phenomenon becomes likely to occur. (The developing ghost phenomenon means a phenomenon which causes a history of the previously developed image appears in the next developed image. More specifically, if collection of non-developed toners from the developing roller is not sufficient, a history of the developed image remains. The supply of toners becomes insufficient if the magnetic brush on the developing roller is not dense, so that the history cannot be covered. Accordingly, the history of the previous image appears in the next developing processing.) Therefore, the weight average particle diameter is set to be equal to or smaller than 50 μm, so that the magnetic brush on the developing roller is formed densely. Since movement of the developer between the developing roller and the magnetic roller is restricted if the magnetic brush of the developing roller is dense, accumulation of the developer becomes likely to occur. However, setting the saturation magnetization per 1 kilo-oersted to be within the range of 25-65 emu/g, accumulation of the developer can be eliminated. Further, if the saturation magnetization is smaller than 25 emu/g, a retaining force applied by the magnetic force becomes too weak, so that the carrier transfer or falling of the developer occurs. On the other hand, if the saturation magnetization is over 65 emu/g, a binding force of the magnetic brush becomes strong and the magnetic brush becomes too strong. Accordingly, unevenness in cleaning by the magnetic brush occurs in the toner thin layer on the developing roller.

Further, according to the present invention, it is preferable that the magnetic roller retains the two-component developer including resin carriers as the carriers, and supplies the toners to the developing roller.

According to this invention, the following effect can be achieved. Specifically, even if resin carriers, which are smaller in specific gravity than ferrite carriers, small in magnetic binding force, low in flowability, and easily causing accumulation of developer and the carrier transfer, are used as the carriers, occurrence of accumulation of developer and occurrence of the carrier transfer can be suppressed by the present invention.

Further, according to the present invention, it is preferable that the magnetic roller retains the two-component developer including carriers having a shape coefficient SF-1 equal to or smaller than 135, and supplies the toners to the developing roller.

According to this invention, the following effect can be achieved. Specifically, carriers have a characteristic that a binding force becomes weak if each carrier has a shape close to spherical. Even if the carriers having such characteristic having a shape coefficient SF-1 of equal to or smaller than 135 and having a shape close to spherical are used, the present invention makes it possible to suppress occurrence of the carrier transfer.

Further, another aspect of the present invention includes an image forming apparatus provided with a developing device in which a two-component developer including at least carriers and toners is used and the toners are supplied to an image bearing member bearing an electrostatic latent image so that a toner image is developed from the electrostatic latent image. The developing device includes: a developing roller so arranged as to oppose the image bearing member; and a magnetic roller so arranged as to oppose the developing roller, the magnetic roller retaining the two-component developer to supply toners to the developing roller. The developing roller and the magnetic roller are rotationally driven in such directions as to be opposite from one another at an opposed position of opposing each other, and a magnetic pole of the magnetic roller and a magnetic pole of the developing roller have magnetic polarities different from one another at the opposed position, and a surface roughness of the magnetic roller is greater than a surface roughness of the developing roller.

This application is based on Japanese Patent application serial No. 2007-144853 filed in Japan Patent Office on May 31, 2007, and Japanese Patent application serial No. 2008-127967 filed in Japan Patent Office on May 15, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device in which a two-component developer including at least carriers and toners is used and the toners are supplied to an image bearing member bearing an electrostatic latent image so that a toner image is developed from the electrostatic latent image, the developing device comprising:

a developing roller so arranged as to oppose the image bearing member; and a magnetic roller so arranged as to oppose the developing roller, the magnetic roller retaining the two-component developer to supply toners to the developing roller, wherein the developing roller and the magnetic roller are rotationally driven in such directions as to be opposite from one another at an opposed position, and a magnetic pole of the magnetic roller and a magnetic pole of the developing roller have magnetic polarities different from one another at the opposed position, and a surface roughness of the magnetic roller is greater than a surface roughness of the developing roller.

2. The developing device according to claim 1, wherein a ten-point average surface roughness Rz (mag) is used as the surface roughness of the magnetic roller, and a ten-point average surface roughness Rz (slv) is used as the surface roughness of the developing roller.

3. The developing device according to claim 2, wherein a relationship between the Rz (mag) and the Rz (slv) is represented by Rz (mag)/Rz (slv)≧1.3, and the Rz (mag) is Rz (mag)≦25 μm.

4. The developing device according to claim 2, wherein the magnetic roller retains the two-component developer including the carriers having a weight average particle diameter equal to or smaller than 50 μm and a saturation magnetization per 1 kilo-oersted of 25-65 emu/g, and supplies the toners to the developing roller.

5. The developing device according to claim 3, wherein the magnetic roller retains the two-component developer including the carriers having a weight average particle diameter equal to or smaller than 50 μm and a saturation magnetization per 1 kilo-oersted of 25-65 emu/g, and supplies the toners to the developing roller.

6. The developing device according to claim 1, wherein the magnetic roller retains the two-component developer including resin carriers as the carriers, and supplies the toners to the developing roller.

7. The developing device according to claim 1, wherein the magnetic roller retains the two-component developer including carriers having a shape coefficient SF-1 equal to or smaller than 135, and supplies the toners to the developing roller.

8. An image forming apparatus provided with a developing device in which a two-component developer including at least carriers and toners is used and the toners are supplied to an image bearing member bearing an electrostatic latent image so that a toner image is developed from the electrostatic latent image, wherein the developing device includes:

a developing roller so arranged as to oppose the image bearing member; and a magnetic roller so arranged as to oppose the developing roller, the magnetic roller retaining the two-component developer to supply toners to the developing roller, wherein the developing roller and the magnetic roller are rotationally driven in such directions as to be opposite from one another at an opposed position of opposing each other, and a magnetic pole of the magnetic roller and a magnetic pole of the developing roller have magnetic polarities different from one another at the opposed position, and a surface roughness of the magnetic roller is greater than a surface roughness of the developing roller.

* * * * *